United States Patent [19]

Kameda

[11] 4,289,298

[45] Sep. 15, 1981

[54] HYDRAULIC LIFTING JACK HAVING A SAFETY LIFTING SADDLE

[75] Inventor: Tamotsu Kameda, Fujinomiya, Japan

[73] Assignee: Yasui Sangyo Co., Ltd., Fujinomiya, Japan

[21] Appl. No.: 107,666

[22] Filed: Dec. 27, 1979

[51] Int. Cl.[3] ..... B66F 5/04

[52] U.S. Cl. ..... 254/8 B

[58] Field of Search ..... 254/2 B, 8 B, 10 B, 254/124, 133

[56] References Cited

U.S. PATENT DOCUMENTS 2,814,394 11/1957 Witcher ..... 254/8 B X

*Primary Examiner*—Robert C. Watson

*Attorney, Agent, or Firm*—Daniel M. Rosen

[57] ABSTRACT

A hydraulic lifting jack on wheels, comprising a pair of frame plates, an elevator which is pivotally mounted on the frame plates, a lifting saddle arranged in the free end of the elevator, and a hydraulic power unit for lifting the elevator, the lifting saddle having front and rear stop members on its front and rear ends, the front stop member being adapted to move up and down so that when the elevator is raised, the top of the front stop member is beyond the upper surface of the saddle, and when the elevator is lowered onto the bottom, the top of the front stop member is positioned below the upper surface of the saddle.

7 Claims, 5 Drawing Figures

HYDRAULIC LIFTING JACK HAVING A SAFETY LIFTING SADDLE

BACKGROUND OF THE INVENTION

This invention relates to a hydraulic lifting jack, and more particularly to a hydraulic lifting jack including a safety lifting saddle having front stop pins which are movable up and down beyond and below the upper surface of the saddle.

In the prior art, when a vehicle is lifted by a jack, a lifting saddle of the jack is moved under the body of the vehicle. However, the front edge of the lifting saddle, which is generally raised somewhat, is inconvenient when the lifting saddle is inserted under the body of the vehicle. The bottom of the vehicle is sometimes damaged by the raised front edge of the lifting saddle of the jack according to the carelessness of an operator. Further, the application of the jack is often restricted by the raised front edge of the lifting saddle.

SUMMARY OF THE INVENTION

It is an object of the present invention to provide a hydraulic lifting jack free from the abovementioned disadvantages, which is simple and reliable.

According to the present invention there is provided a hydraulic lifting jack on wheels, comprising: a pair of frame plates; an elevator which is pivotally mounted to the frame plates; a lifting saddle arranged in the free end of the elevator; and a hydraulic power unit, mounted to the frame plates, for lifting the elevator, characterized in that the lifting saddle is provided with front and rear stop members in its front and rear ends, and the front stop member is adapted to move up and down so that the top of the front stop member may be positioned, when the elevator is raised, beyond the upper surface of the saddle, and, when the elevator is lowered onto the bottom, below the upper surface of the saddle.

DESCRIPTION OF THE DRAWINGS

In order that the present invention may be better understood, a preferred embodiment thereof will now be described with reference to the accompanying drawings, in which.

DESCRIPTION OF A PREFERRED EMBODIMENT

Figure 2:
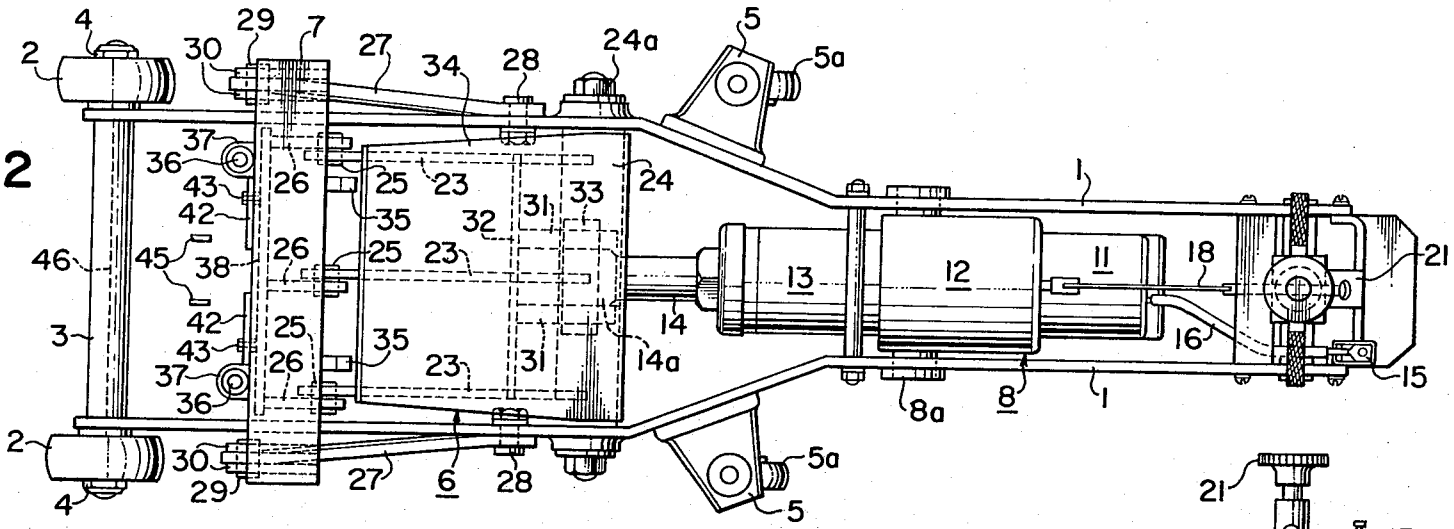
FIG. 2 is a top view of FIG. 1.
Figure 1:
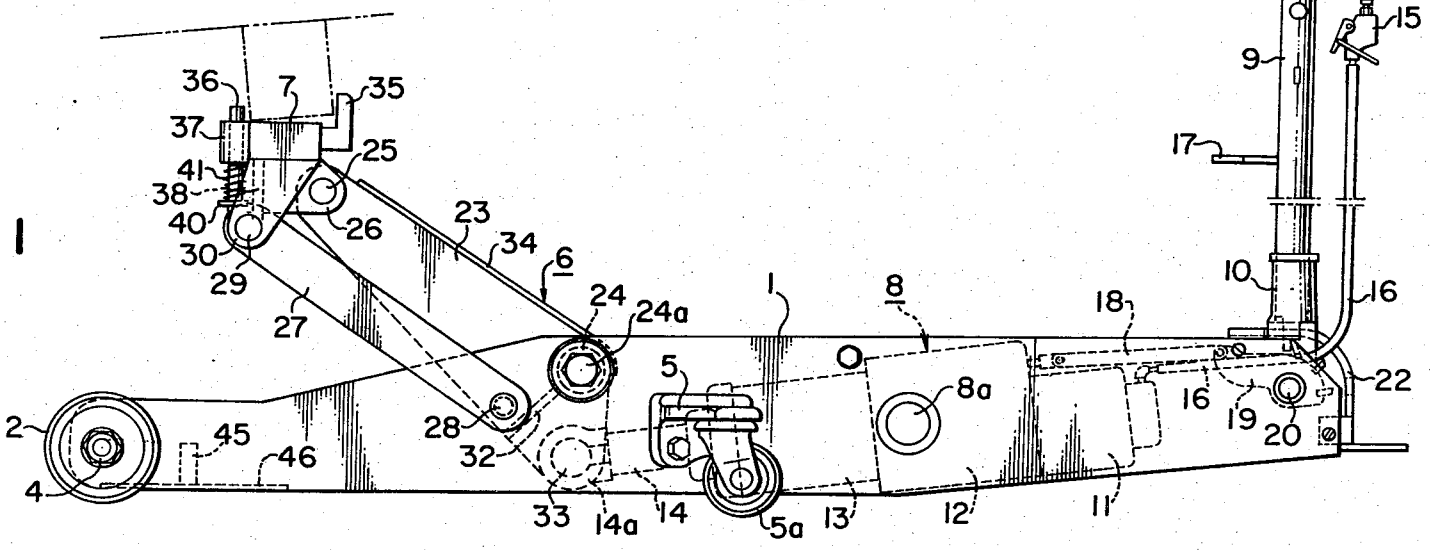
FIG. 1 is a side view of a hydraulic lifting jack according to the present invention.

Referring now to the drawings, in which the same numerals denote the same parts, there is shown in FIGS. 1 and 2 a low-slung hydraulic lifting jack comprising a pair of frame plates 1; a pair of front wheels 2 which are rotatably mounted to the frame plates 1 through a shaft 3 and nuts 4; a pair of rear casters 5 with rear wheels 5*a*, mounted to the central portions of the frame plates 1; an elevator 6, pivotally mounted to the frame plates 1, for lifting an object; a lifting saddle 7 arranged in the free end of the elevator 6; a hydraulic power unit 8 for lifting the elevator 6, which is mounted to the frame plates 1 by a mounting member 8*a*; and a handle assembly 9 including a handle rod for lowering the elevator 6, which is mounted to the frame plates 1 in its end portion by a yoke 10.

The hydraulic power unit 8 of substantially conventional construction comprises an air pump cylinder 11, an oil pump means 12 actuated thereby, an oil cylinder 13 connected thereto, and an actuating rod 14 connected thereto. When the elevator 6 is raised, air compressed is supplied to the air pump cylinder 12 from a compressor (not shown) via an air valve 15 and a conduit 16 which is connected between the air pump cylinder 11 and the air valve 15, and the air pump cylinder 11 actuates the oil pump means 12 pushing the oil cylinder 13. Then, the actuating rod 14 is extended forwards, i.e. the left hand side direction in FIG. 1, by the oil cylinder 13, and thereby the elevator 6 coupled to the actuating rod 14 is raised, as hereinafter described.

When the elevator is lowered, a lever 17 connected to the handle rod of the handle assembly 9 is pivoted in a horizontal plane, and then a cam plate 19 which is engaged with the lower end of the handle rod is rotated clockwise in FIG. 1 around a shaft 20. Then, a coupling rod 18 connected to the cam plate 19 is pulled in the right hand side direction, and thus the by-path of the oil pump means 12 is opened, with the result that the actuating rod 14 is retreated while the elevator 6 is lowered.

In this embodiment, the angle of the handle assembly 9 disposed is adapted to be changed in three positions by pivoting around the shaft 20 by operating a knob 21 positioned in the free end of the handle rod, along a curved guide member 22.

The elevator 6 of substantially conventional construction comprises three elevator arms 23 one ends of which are connected to a pivot shaft 24 which is pivotally mounted to the frame plates 1 by nuts 24*a*, and the other ends of which are pivotally mounted to brackets 26 of the saddle 7 via pivot pins 25, and a pair of link bars 27, one ends of which are pivotally connected to the frame plates 1 via pivot pins 28, and the other ends of which are pivotally mounted to side legs 30 of the saddle 7 via pivot pins 29. The top ends of the elevator arms 23 are covered by a cover plate 34.

To the one ends of the elevator arms 23 is secured a cross plate 32 to which a link shaft 33 is mounted by support plates 31. On the center of the link shaft 33 is pivotally coupled to the front end portion 14*a* of the actuating rod 14.

While the elevator 6 is raised by moving forwards the actuating rod 14, the lifting saddle 7 is always kept horizontal by a parallelogram link mechanism with four vertexes, i.e. the pivot shaft 24 and the pivot pins 25, 28 and 29.

Figure 3:
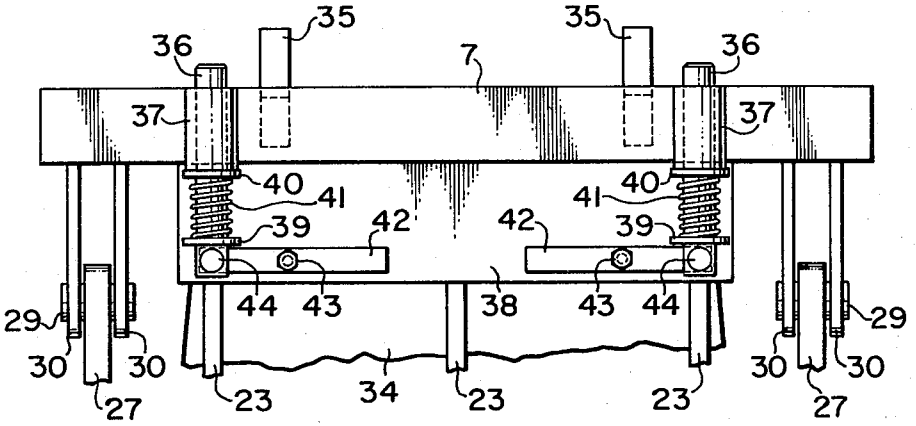
FIG. 3 is a fragmentary front view of the jack in FIG. 1, when an elevator is lifted up.
Figure 5:
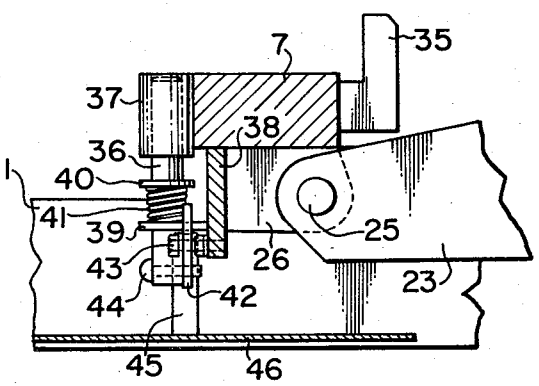
FIG. 5 is a side view of FIG. 4.
Figure 4:
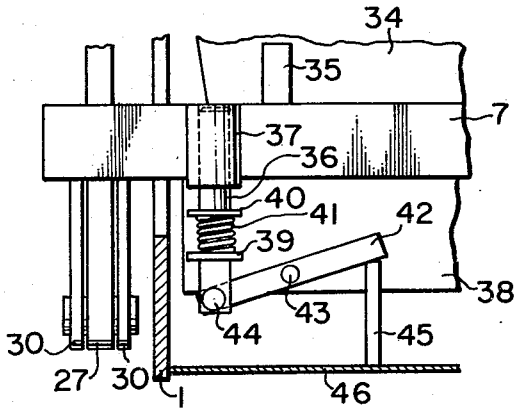
FIG. 4 is a fragmentary longitudinal cross-section when the elevator is lowered down onto the bottom.

There is shown the lifting saddle 7 which is raised in FIG. 3, and is lowered on the bottom in FIGS. 4 and 5. A pair of rear stop members 35 are mounted to the rear end of the saddle 7. A pair of front stop pins 36 are mounted movably up and down to the front end of the saddle 7 at a certain distance away by guide members 37. A support block 38 is secured to the front portion of the bottom of the saddle 7. To the support block 38 are mounted spring stop members 39, each having a hole through which the front stop pin 36 is inserted.

Each front stop pin 36 is provided with a flange 40 in its middle portion. A coil spring 41 is so fitted on the front stop pin 36 between the spring stop member 39 and the flange 40 of the front stop pin 36, as to bias the front stop pin 36 upwards so that its top end may project beyond the upper surface of the saddle 7, as clearly shown in FIG. 3. For each front stop pin a pivot bar 42 is pivotally mounted to the support block 38 at its center by a pivot bolt 43, and one end of the pivot bar 42 is pivotally mounted to the lower end of the front stop pin 36 by a pivot pin 44.

A pair of stoppers 45 are erected on a bottom plate 46 across the lower ends of the frame plates 1 so that, when the lifting saddle 7 is lowered onto the bottom, the stoppers 45 may push up the free ends of the pivot bars 42 against the coil springs 41, and therefore the top ends of the front stop pins 36 may be lowered below the upper surface of the saddle 7, as clearly shown in FIGS. 4 and 5.

Although the present invention has been shown and described in terms of a preferred embodiment thereof with reference to the accompanying drawings, various changes and modifications could be made by those skilled in the art without departing from the scope of the present invention.

What is claimed is:

1. A lifting jack, comprising: a base; an elevator which is mounted to the base so as to be raisable and lowerable; a lifting saddle disposed at the free end of the elevator; power means adapted to raise and lower the elevator; at least one movable stop means mounted to the lifting saddle so as to be movable in a substantially vertical direction; and actuating means coupled to said movable stop means and adapted to automatically raise said movable stop means to project above the lifting saddle upper surface when the elevator is raised, and further adapted to automatically lower said movable stop means so as not to project above the lifting saddle upper surface when the elevator is lowered beyond a certain point.

2. A lifting jack as claimed in claim 1, wherein said movable stop means is a front stop means, and the jack further comprises a fixed rear stop means, which projects at all times above the lifting saddle upper surface.

3. A jack as claimed in claim 1 or 2, wherein said movable stop means comprises at least two peg members spaced apart and mounted to the lifting saddle so as to be slidable up and down.

4. A jack as claimed in claim 1 or 2 in which the actuating means comprises: a lever pivotally attached to the elevator and having one end cooperating with said movable stop means and the other end adapted to engage with the base when the elevator is lowered so as to lower the movable stop means below the lifting saddle upper surface.

5. A jack as claimed in claim 4, in which the actuating means further comprises spring means biasing the movable stop means upward.

6. A jack as claimed in claim 3 in which the actuating means comprises: a lever pivotally attached to the elevator and having one end pivotally attached to a lower portion of said peg member and the other end adapted to engage with the base when the elevator is lowered so as to lower the peg member below the lifting saddle upper surface.

7. A jack as claimed in claim 6 in which the actuating means further comprises spring means biasing the peg member upward.

* * * * *